US006152424A

United States Patent [19]

Lapat

[11] Patent Number: 6,152,424

[45] Date of Patent: Nov. 28, 2000

[54] DOOR AND WINDOW FRAME SPREADER

[76] Inventor: Leo A. Lapat, 1815 Buck Rd., Feasterville, Pa. 19053

[21] Appl. No.: 09/505,534

[22] Filed: Feb. 17, 2000

[51] Int. Cl.[7] ..... B66F 3/08

[52] U.S. Cl. ..... 254/98; 254/133 A

[58] Field of Search ..... 254/133 A, 98, 254/100; 248/354.3, 354.5

[56] References Cited

U.S. PATENT DOCUMENTS

| | | | |
|---|---|---|---|
| 1,227,105 | 5/1917 | Barnes | 254/133 A |
| 1,723,970 | 8/1929 | Jauch . | |
| 2,617,620 | 11/1952 | Jessop | 254/98 |
| 2,637,555 | 5/1953 | Klaust . | |
| 2,777,660 | 1/1957 | Albrecht | 254/133 A |
| 2,814,459 | 11/1957 | Hyre . | |
| 3,229,940 | 1/1966 | Kagels | 248/354.5 |
| 4,890,818 | 1/1990 | Williams . | |
| 5,092,504 | 3/1992 | Hannes . | |
| 5,114,127 | 5/1992 | Everhart . | |
| 5,971,362 | 10/1999 | Clark . | |

*Primary Examiner*—Robert C. Watson
*Attorney, Agent, or Firm*—Daniel Kramer

[57] ABSTRACT

A screw device for imposing spreading forces on opposing surfaces, having a pin adjustable length and employing a rod member having a groove in the end for engaging the pin.

10 Claims, 3 Drawing Sheets

DOOR AND WINDOW FRAME SPREADER

BACKGROUND

1. Field of the Invention

The invention relates to a tool for engaging the vertical or horizontal sides of a door frame and applying force thereto for the purpose of pushing apart the sides to allow an otherwise oversize door to fit properly.

2. Prior Art (A) R. J. Jauch; U.S. Pat. No. 1,723,970 issued Aug. 6, 1929; SCREW JACK:

(B) H. R. Klaudt; U.S. Pat. No. 2,637,555, issued May 5, 1953; EXERCISE BAR (C) R. W. Hyre; U.S. Pat. No. 2,814,459, issued Nov. 26, 1957; ALIGNING DEVICE (D) M. G. Williams; U.S. Pat. No. 4,890,818, issued Jan. 2, 1990; DOOR FORCING APPARATUS (E) A. E. Everhart; U.S. Pat. No. 5,114,127, issued May 19, 1992; PLUMB-ALIGN DEVICE (F) K. J. Hannes, et al; U.S. Pat. No. 5,092,504, issued Mar. 3, 1992; BICYCLE RACK FOR PICK-UP TRUCK (G) M. C. Clark; U.S. Pat. No. 5,971,362, issued Oct. 26, 1999 WALL PANEL JACK

DISCUSSION: PRIOR ART

While several of the prior art disclosures cited above employ principles of operation or construction which appear similar to that disclosed and claimed herein, none of them are directly concerned with the problems solved by the instant invention.

While substantially all the known prior art recited above employ similar principles such as the use of oppositely threaded screws to apply an axial force to opposed objects, or the use of spaced holes and pins to provide gross dimensional adjustment, the construction of all are excessively complicated and costly to produce.

Therefore, to emphasize the simplicity and novelty of applicant's invention the above art will be briefly reviewed and certain distinctions pointed out.

Of the prior art cited Jauch, Klaudt, Eberhart and Hannes have oppositely pitched collinear threaded rods engaging correspondingly threaded nuts positioned in opposing members. The collinear rods are butted and joined and are provided with means for turning the threaded rods together, whereby the nuts, their respective opposing members, and the structures they join or on which they bear, are forced apart or dragged together depending on the direction the rods are rotated. In an alternate displayed construction, a single rod is threaded at opposite ends with opposite pitches. The net performance of the two constructions is identical.

By contrast, applicant's invention has oppositely threaded rods which do not turn at all.

Hyre shows oppositely threaded rods in a turnbuckle construction. However, it is apparent that his turnbuckle 11 cannot resist compressive forces nor exert substantial outward forces as required by the instant invention.

Willams and Clark both show oppositely threaded rods with a central oppositely threaded nut 61. However neither show any step-wise length adjustability and, while Williams has an objective similar to the invention disclosed herein, Williams construction is far more complex and ill adapted to achieve the present purposes.

Jauch, Hyre, Everhart and Hannes, are the only prior art teaching devices having lengths adjusted by pins or bolts engaging one of a series of axially positioned spacer holes. All these require that the pins or bolts traverse a hole in a stationary element and a corresponding hole in a moveable element, thereby requiring positioning and precise alignment of the parts prior to insertion of the spacer pin. By contrast, applicant employs notches or grooves at the end of abutting members to readily engage specer pins, thereby eliminating the need for precise alignment of two pairs of holes.

Further, applicant has disclosed and claimed a novel grove or notch at member ends for spacer pin engagement, the notch having a wider portion positioned away from the notch opening.

Finally, applicant discloses stabilizing members attached to the end blocks of his mechanism, thereby providing lightweight but stable broad bases for supporting or holding unwieldy sheets or panels in place prior to fastening.

Applicant will demonstrate that his invention has new and unobvious elements which improve on and simplify both the construction and use of his device over those cited above found in the art.

BACKGROUND

Field erected door and window frames are typically secured to interior wall framing whose dimension are famously inexact. Therefore, it has been routine and good practice to secure proper alignment by mounting and aligning the door or window frame members with wooden wedges whose position can be adjusted to secure substantially perfect initial fit between the door and the frame.

However, as structures age it is common for their doors and windows to bind or fail to open easily or to close because of relative motion of the door frames caused by structure settlement, expansion or shrinkage, or because the door itself has warped or expanded from dampness or other causes.

SUMMARY OF THE INVENTION

A device for exerting force against a opposite portions of a door or window frame. The device has first and second end blocks. Each block has a resilient face for engaging the door frame portions. The device includes screw means for exerting force against the end blocks.

The screw means includes a first tubular element having a first length and having a first end and a second end. The second end engages the second block. The first tubular element has a series of hole pairs diametrically traversing the element and spaced along the length of the element. There is a first pin having a diameter positioned in one of the hole pairs.

The screw means further includes a first rod element having a first and a second end. The rod is positioned with its first end engaging the first block. The first rod also has screw threads having a first pitch and a first direction formed in its second end.

The screw means further includes a second rod element having a first and a second end. The first end of the second rod element has screw threads having a second pitch and second direction. The second end of the second rod element has a slot formed therein. The slot has sides defining an opening end and a closed end. The sides are spaced apart a first distance at the opening, the first distance being greater than the pin diameter. The sides adjacent the closed end are spaced apart a second distance. The second distance is greater than the first distance. The second rod element is positioned coaxially with both the first rod element and the first tubular element and the rod second end is positioned within the tubular element.

OBJECTS AND ADVANTAGES

It is an object of the present invention to provide a simple yet powerful device for forcing apart and spreading the sides of a door or window frame.

It is a further object to provide such a device having adjustability to conform to wider or narrower frames.

It is a further object to provide such a device which can be augmented with extensions for forcing apart or spreading widely separated members such as a top of a door frame and the floor below.

It is a further object to provide such a device which will, with extensions, hold in place against ceiling rafters a full sheet of drywall, leaving a helper for another task.

It is a further object to provide such a device which will, with extensions, hold kitchen cabinets in place while being secured to a wall.

It is a further objective to provide such a device which can be readily taken apart and reassembled.

It is a further object to secure easy assembly without the need for aligning holes in two components.

It is a further objective to provide such a device using the principle of differential threads to provide great force with hand torque only.

It is a further objective to provide such a device which can be fabricated with standard size rods and pipes.

It is a further objective to provide such a device which can readily be adapted to other similar purposes by the addition of stabilizer members.

Further important objectives and advantages will be disclosed during the exposition of the details of design and usage of the device.

DETAILED DESCRIPTION OF THE INVENTION

Figure 1:
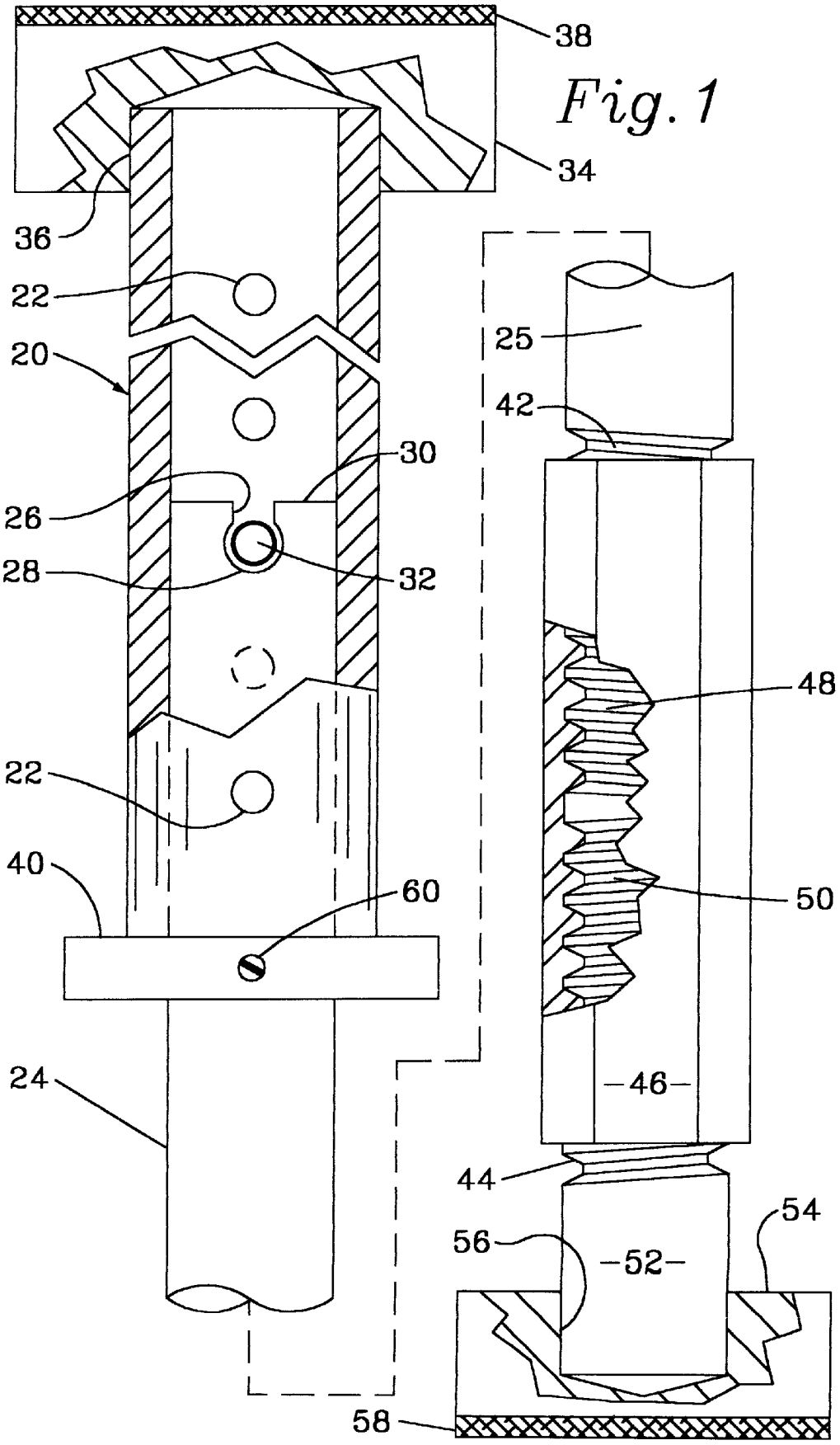
FIG. 1 shows an enlarged crossection of the major components.

Homeowners and carpenters often encounter the need to cope with and repair situations where doors bind and fail to close. This problem can arise both in new and older homes. In new homes the problem most frequently arises from hasty setting of the door frame. In older homes the problem arises from excessive expansion of the door with time and from moisture or from settling or shifting of the home structure, leading to reduction of the opening between door frame members limiting free motion of the door within.

In either case the repair person has the options of attempting to spread apart the door frame members by hammering on one side or the other with the attendant risk of marring or otherwise damaging the door frame, even with a two by four buffer, or in the alternative, of removing the door and planing the offending edge. Further, hammering is inherently an imprecise procedure and can easily lead to an excessive gap between the door and frame. Where the area of interference is midheight of the door, the lock plate and mechanism must be removed before planing and the lock must be reset afterwards, an operation requiring substantial skill and time. Further, after planing the door edge, in most cases the door must be repainted or refinished. The carpenter most frequently walks away from this problem and leaves the homeowner with the cost and annoyance of matching paints and finishes. Further, while steel doors frequently have wood vertical edges whcih can be planed slightly, tho tops of steel door cannot be altered.

The instant invention allows the homeowner or carpenter to gradually apply increasing force to the frame, thereby allowing the frame to be moved precisely the amount required for normal door opening and closing. Clearly the merits of the corrective procedure made possible by the invention are overwhelming compared with the alternatives.

A frame spreading device must be designed and constructed to allow it to be applied to a wide range of door widths. Because of the relatively wide range of widths need to be addressed, a long forcing screw, while theoretically suitable, would not be either cost effective or mechanically strong enough in compression to resist bending under the high stress needed to perform the desired function. Therefore, a sound, cost effective construction, involves the design with a relative short forcing screw and step-wise adjustments, best secured by spaced holes with a moveable pin positioned in one of the holes. The pin position, of course, is selected to establish the correct overall device length to allow the forcing screw to operate within its range.

Prior devices, developed for use in other applications, have provided that the spacing pin must engage a hole in both the fixed and the moveable member. While this is relatively easy to do while standing at a well lit bench, such hole alignment becomes an annoying problem when attempted in a dimly lit working environment, on ladders or at heights or under other stressful conditions.

Therefore, the present invention has solved that annoying problem by eliminating the alignment hole in the movable part and instead providing a slot in the end of the movable part that can engage the pin when the part is moved toward the pin sufficiently to contact it. Where it is expected that great rotative force must be resisted by the slot-pin engagement, a special slot is provided with an interior recess, thereby allowing the slot to easily engage with and disengage from the pin under hand force, but to fully resist any turning torque which might be imposed by a lever or wrench.

FIG. 1:

In the following description, thread handedness is described as right when clockwise rotation of the parts is required for assembly. In cases where two members are described as have opposite thread directions, either member may have the right or the left hand thread with the other member having a thread of opposite direction.

Referring now to FIG. 1 there is shown end block 34 for engaging and pressing against on side of a door frame, spacer tube 20 secured to the end block; and rod 24 inserted into and spaced within tube 20. The end of rod 24, which is not inserted into tube 20, is threaded with right-hand threads and is threaded into nut 46, one half of which is also threaded with mating right hand threads. The other half of nut 46 is threaded with left hand threads to match the left hand threads formed on secondary rod or stud 52. The unthreaded end of stud 52 is secured in block 54. Blocks 34 and 54 are positioned to apply the required force to opposing parts of the frame to be stretched. To prevent any damage to the frame or marring of the frame finish, a resilient non-mar pad 38 is supplied securely fastened to block 34 and a similar pad 58 to block 54. The pads are fastened to the blocks by adhesive or by a hook-loop fastener pair or other convenient manner.

Block 34 is formed with a recess 36 having an inside diameter about 0.003 inch smaller than the diameter of the spacer tube 20 described below, thereby providing an interference fit that is substantially permanent.

In a typical embodiment the blocks 34 and 54 are formed of steel or cast iron and are 4 inches long by 1.5 inches wide by one inch deep. The resilient non-mar pads are about ⅛ inch thick and made of felt or foam material. In alternate embodiments the blocks are made of aluminum or other light material.

Spacer tube 20 is provided having a series of seven spacing holes 22 diametrically bored 5/16 inch diameter substantially perpendicular to the central axis of tube 20 and spaced at intervals along the length of the tube axis, the intervals being within the range of movement of the forcing threads 42,44 and nut 46. Typically spacer tube 20 is formed of US schedule 40 steel pipe having an overall length of 17.5 inches, an outside diameter of 1.050 inches, an ID of 0.824 and a wall thickness of 0.113 inches. Naturally, other pipe sizes and material and other lengths may be selected to suit each particular application.

Rod 24 is inserted into tube 20 and its distance of insertion is determined by the position of pin 32. Typically, rod 24 is formed of mild steel, is 19 inches long and has a diameter of ¾ inch or such diameter that will allow it to freely enter and be withdrawn from tube 20. Rod 20 is formed with a grooved end 30 and a threaded end 25.

One of the great disadvantages of prior devices which could have been modified to perform the desired objective is the need for lining up an inside hole formed in a rod with the outside hole so the pin can be inserted through both. For instance, Jauch states at lines 81–85, "The tubes 13 have made therein a series of perforations 15, and pin 16 extends through the tube 14 and through corresponding perforations in the tube 13 . . . " In dim light or standing on a ladder such alignment and insertion becomes uncertain and frustratingly difficult.

The instant invention neatly solves the alignment problem by providing a groove 26 in the end 30 of the inner rod member 24. The walls 26 of the groove are typically spaced 0.317 apart to allow the 0.3125 inch diameter pin 32 to enter by the simple expedient of turning rod 24 so that the groove walls 26 line up with pin 32. At that time, under slight manual pressure, the pin enters the groove and thereby prevents rod 24 from moving further into tube 20, just as if the pin 32 had actually traversed corresponding holes in the two members, rod 24 and tube 20.

While the simple groove having parallel sidewalls 26 is satisfactory for most applications, the pin has been known to jump out of the groove under heavy torques arising from adjusting efforts. To overcome this problem, the groove walls 26 are enlarged into a cavity 28 at a distance away from the end 30 of rod 24. The cavity 28 may be tubular as shown or have another shape, so long as the distance between the cavity walls 28 is greater than the distance between groove walls 24. Typically the distance between the cavity walls is 0.025 greater than the spacing of the walls 26 adjacent the slot end. With this construction, no torque on rod 24, no matter how great, can cause pin 32 to pop out of groove 26.

A collar 40 is provided, locked to rod 24 by set screw 60, to provide convenient means for turning rod 24 when it is inserted substantially fully into tube 20. Typically the diameter of the collar is 1.25 inches and its width is one half inch.

The threaded end 25 of rod 24 is formed with a right-hand Acme thread 42 having 6 threads per inch. The Acme thread was chosen for its mechanical strength and resistance to stripping. Other thread forms and pitches having similar physical characteristics would also be suitable.

Nut 46 is formed of steel and has an overall length of about 4.5 inches. One half the interior length of nut 46 is formed with a right hand female Acme thread 48 that matches the thread 42 formed on the end 25 of rod 24. The other half of the interior length of nut 46 is formed with a left hand female Acme thread 50 having a 6 per inch pitch.

Stud 52 is formed of ¾ inch OD steel rod and is provided with a left hand Acme thread 44 matching the left hand thread 50 formed in the interior of nut 46. Stud 52 is formed with a substantially smooth end that is inserted into a recess 56 in end block 54. The recess 56 is sized to form an interference fit with the smooth end of stud 52, typically about 0.003 inches smaller than the diameter of the smooth end of stud 52.

Figure 2:
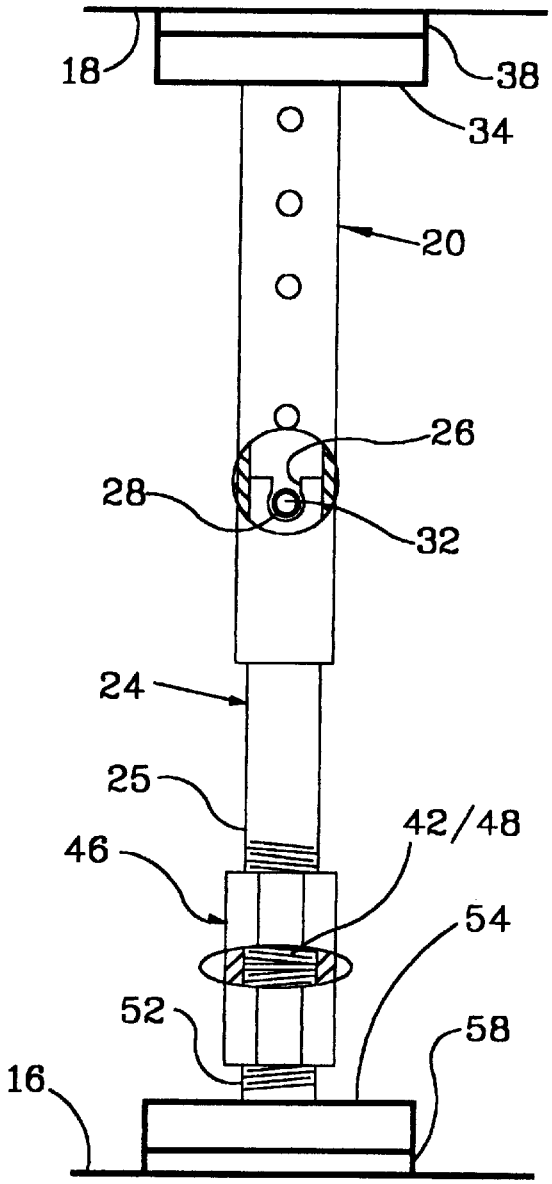
FIG. 2 shows the assembled unit with sections at crucial points.

FIG. 2:

Referring now to FIG. 2 there is shown the apparatus of the invention in assembled form, positioned between two surfaces 16 and 18 that are to be forced apart to allow some interior object, such as a door or window to fit properly between them. Nut 46 is shown in partial section displaying the oppositely formed threads of the rod 24 and the stud 52 threaded within. Spacer tube 20 is shown in partial section displaying the groove 26 with its enlarged distal end 28 engaging pin 32.

Rotating nut 46 in a first direction causes it to wind onto both rod 24 and stud 52 because of the oppositely threaded parts, thereby shortening the overall length of the assembly and reducing force on surfaces 16 and 18. Rotating nut 46 in the opposite direction causes nut 46 to wind off both rod 24 and stud 52, thereby increasing the overall length of the assembly and causing great force to be applied to surfaces 16 and 18, thereby forcing the surfaces apart and spreading them. Because substantial force may be required to secure the desired degree of spreading or movement of surfaces 16, 18, significant torque may have to be applied to nut 46. For minor forces, only hand torque may be sufficient. For greater torque a pin inserted into a hole in the side of nut 46 may provide sufficient leverage. For still greater torque, a wrench applied to flats on nut 46 may be required.

Note that each revolution of nut 46 causes the blocks 34,54 to separate a distance of two thread pitches.

Figure 3:
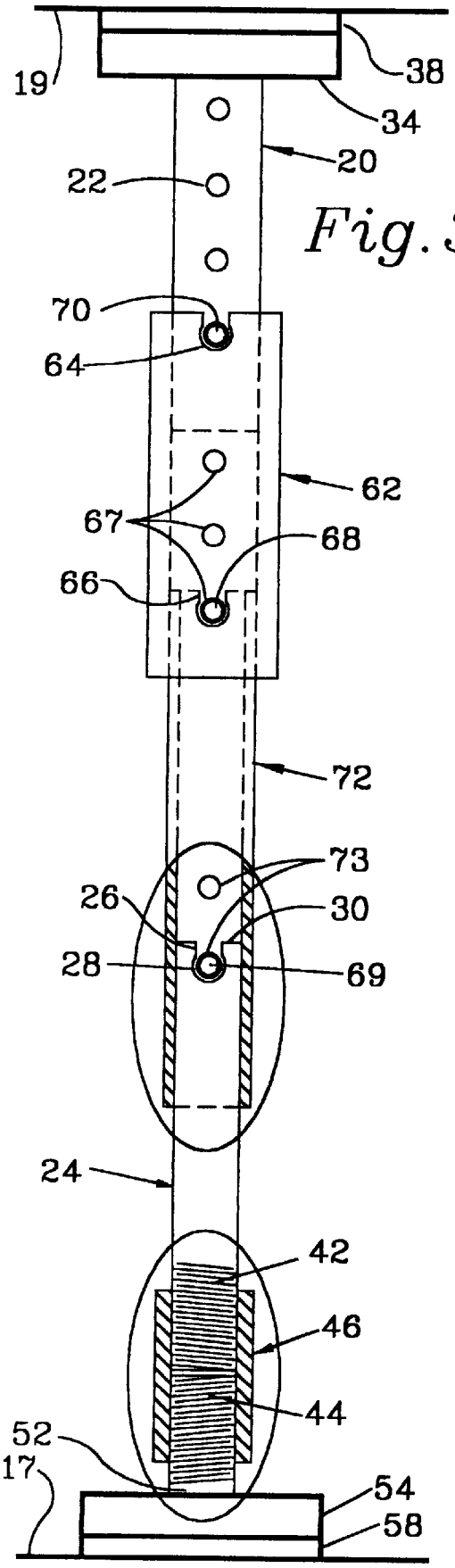
FIG. 3 illustrates the use of extension members to adapt the basic device to door frames or other members having greater distances between opposed elements.

FIG. 3:

Referring now to FIG. 3, there is shown the basic structure of FIG. 2 augmented by extension tubular members 62 and 72 that allow the spreading force on blocks 34 and 54 provided by threads 42 and 44 in cooperation with the mating threads of nut 46 to be applied to members or moldings 17/19 that are further apart than the side frames of doorways. Among such applications are the spreading of the top frame of a doorway, the securing in place of a ceiling dry-wall panel while it is screwed or otherwise secured in place or the holding and adjustment of the position of a kitchen cabinet while it is secured in place.

In FIG. 3 a larger diameter tubular spacer 62 (second tube) is provided with end slot 64 and spaced apart 2/16 inch holes 67 in which spacer pin 68 can be positioned. Slot 64 is positioned to engage pin 70 in tube 20. Slot 66 is formed in one end of smaller extension tube 72 (third tube) and is positioned to engage pin 68 (second pin) which is positioned in one of the holes 67 formed in spacer tube 62. The other end of extension tube 72 is formed with a series of holes 73 in one of which pin 69 can be positioned to engage slot 26 formed in the end of rod 24. The selection of holes 22, 67 and 73 in which pins are positioned is made to establish the correct overall distance between blocks 34 and 54 for insertion between and subsequent engagement and spreading of the structural members or articles to be spread or held.

In FIG. 3, exactly the same principle for adjustment and application of force to the opposed frame members 17 and 19 applies as in FIG. 1 where turning nut 46 causes its oppositely pitched threads to move rod 24 away from stud 52, thereby providing the desired force on blocks 34 and 54 to move associated frames or panels apart.

In FIG. 3, typically tube 72 is 30 inches long and has an OD of 1 3/16 inches and an ID of 13/16 inches. Typically tube 62 is 23 inches long, has an OD of 1.315 inches and an OD of 1 1/16 inches. Naturally, other diameters and lengths of the tubes can be selected to meet varying requirements.

Figure 4:
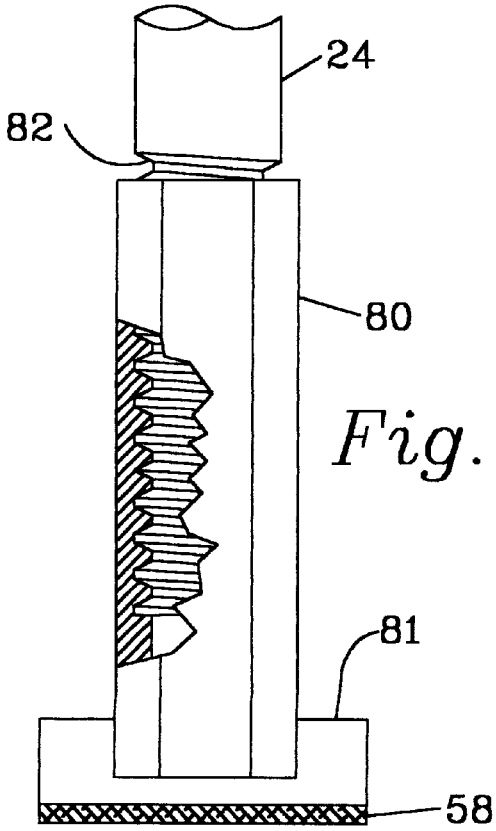
FIG. 4 illustrates a simplified embodiment having a single screw.

FIG. 4:

FIG. 4 displays another embodiment of forcing threads where stud 52 is eliminated and nut 80 rotates in a clearance recess in block 81. Rod 24 has threads 42 formed in its end. These threads engage mating threads in nut 80. Since each revolution of nut 80 moves apart the block 81 and its opposite block (not shown) by one thread pitch only of threads 42, greater mechanical advantage, but reduced movement, is provided for each revolution of nut 80 compared with the oppositely pitched threads in nut 46 of FIGS. 1, 2 and 3.

Figure 5:
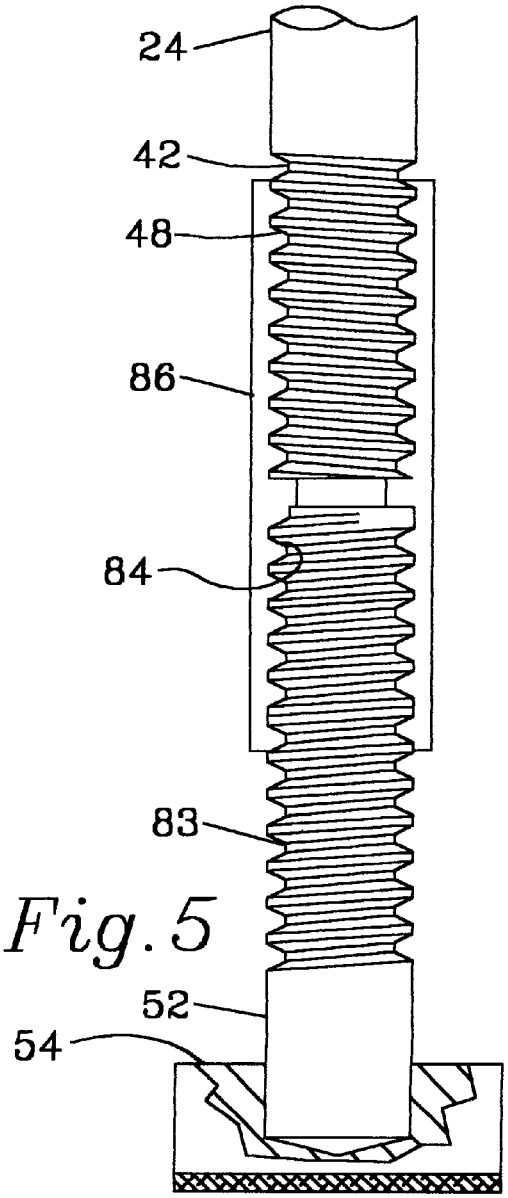
FIG. 5 discloses an embodiment employing a differential thread.

FIG. 5:

In FIG. 5 a differential threading arrangement is provided that provides very great mechanical advantage. In this embodiment stud 52 and matching nut portion 84 is provided with a left-handed thread 83 having a pitch less than the pitch of right hand thread 42 on rod 24 and the matching thread on nut 86. In this arrangement one revolution of nut 86 moves the nut one pitch distance of thread 42 while the stud moves only one-half pitch distance in the opposite direction on threads 83, thereby providing a relative motion between the stud and rod equal only to the difference in the pitches between the two threads. In a second embodiment of the differential thread of FIG. 5, stud 52 and matching nut portion 84 are provided with a thread having the same direction as thread 42 on rod 24 and its matching thread in nut 86 but with a lesser pitch, thereby generating the desired differential effect.

Figure 6:
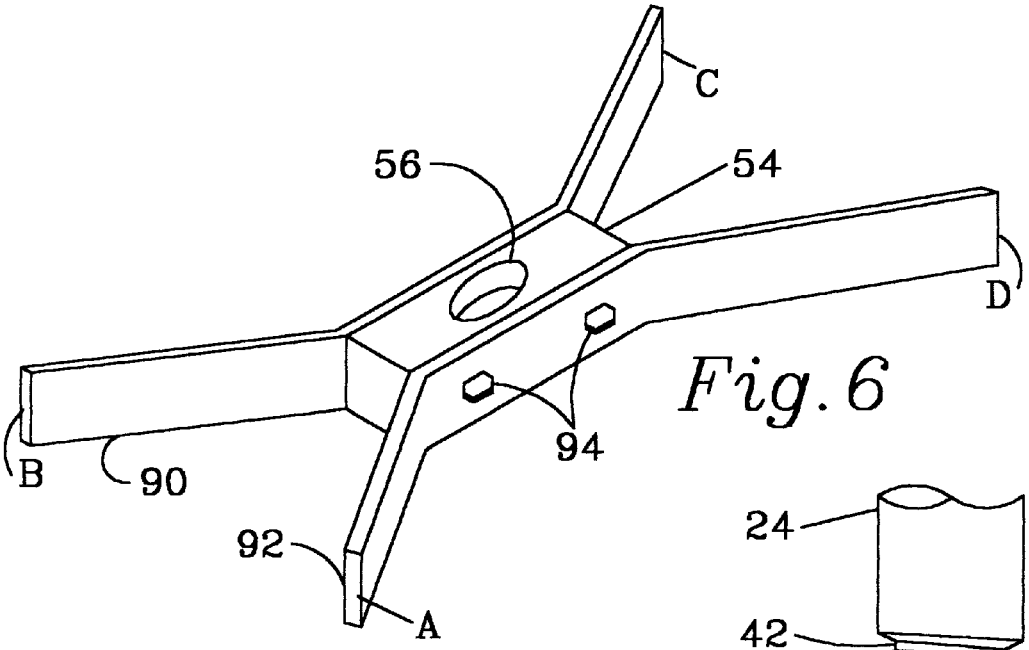
FIG. 6 displays an end block of the device which is fitted with stabilizer bars to improve handling of large sheets of material.

FIG. 6:

In FIG. 6 there is shown end block 54 with hole 56 but with rod 52 omitted for clarity. Stabilizing members 90 and 92 are secured to end block 54 with bolts 94. The stabilizing members are bent to provide a substantially square format for ends A, B, C and D of the stabilizing members 90 and 92; that is with the distances between ends A and B substantially equal to the distances between ends A and D; D and C; and between B and C. Similar stabilizing members are provided for blocks 34 and 81, if required. Typical distances between A and B are 12 inches for supporting cabinets and 36 inches for supporting sheet rock at the ceiling level. Naturally, the lengths of members 90 and 92 are seletced to meeting the requirements.

Preamble To Claims:

From the foregoing description, it can be seen that the present invention comprises a device for controllably imposing spreading, stretching or holding forces on opposed objects. It will be appreciated by those skilled in the art that changes could be made to the embodiments described in the foregoing description without departing from the broad inventive concept thereof. It is understood, therefore, that this invention is not limited to the particular embodiment or embodiments disclosed, but is intended to cover all modifications which are within the scope and spirit of the invention as defined by the appended claims, its elements and equivalents thereof.

I claim:

1. A device for exerting force against opposing portions of a structure said device comprising:

first and second end blocks having resilient faces for engaging the structure portions;

adjustable means for exerting force against the end blocks said means comprising;

a first tubular element having a first and second end, the second end engaging the second block, said tubular element having a length and having at least one hole pair diametrically traversing the element and positioned along the length, and a first pin having a diameter positioned in said hole pair;

a first rod element having a first and a second end, said rod first end engaging the first block, and screw threads having a first pitch and a first direction formed in the second end; the first rod element being positioned coaxially with the first tubular element;

a second rod element having a first and a second end, the first end having screw threads having a second pitch and second direction, said second rod element being positioned coaxially with both the first rod element and the first tubular element and with the rod second end positioned within the tubular element first end, an internally threaded nut engaging the threaded ends of the first and second rods, the second end of the second rod having a slot formed therein, the slot having an opening and a bottom, the slot having a first portion positioned substantially adjacent the opening, said first portion having a first width, the first width being sufficient to allow passage of the first pin.

2. A device as recited in claim 1 further providing that said slot has a second portion positioned between the slot bottom and the portion occupied by the first width, said second portion having a width greater than the first width.

3. A device as recited in claim 2 further providing that the second thread direction is opposite the first thread direction and the second thread pitch is the same as the first thread pitch.

4. A device as recited in claim 2 further providing that the second thread direction is opposite the first thread direction and the first thread pitch is different from the second thread pitch.

5. A device as recited in claim 2 further providing that the second thread direction is the same as the first thread direction and the first thread pitch is different from the second thread pitch.

6. A device as recited in claim 2 further providing angled stabilizing elements secured to the end blocks, said stabilizing elements having ends, the elements being formed to position the ends in a substantially square format, said square having a side dimension between 12 and 36 inches.

7. A device for exerting force against opposing portions of a structure said device comprising:

first and second end blocks having resilient faces for engaging the opposing structure portions;

coarse and fine adjustable means for exerting force against the end blocks said means comprising;

a first tubular element having a first and second end, the second end engaging the second block, said tubular element having a length and having at least one hole pair diametrically traversing the element and positioned along the length, and a first pin having a diameter positioned in said hole pair;

a first rod element having a first and a second end, said rod first end engaging the first block, and screw threads having a first pitch and a first direction formed in the second end; the first rod element being positioned coaxially with the first tubular element;

a second rod element having a first and a second end, the first end having screw threads having a second pitch and second direction, said second rod element being positioned coaxially with both the first rod element and the first tubular element and with the rod second end positioned within the tubular element first end, an internally threaded nut engaging the threaded ends of the first and second rods, and further providing a first slot formed in the second end of the second rod, the slot having an opening and a bottom, the slot having a first portion positioned substantially adjacent the opening, said first portion having a first width, the first width being sufficient to allow passage of the first pin and further providing that said slot has a second portion positioned between the slot bottom and the portion occupied by the first width, said second portion having a width greater than the first width, whereby the first pin, in the course of resisting torsional force applied between the second rod and the first tubular element, is positively confined within the first slot.

8. A device as recited in claim 7 further providing that the second thread direction is opposite the first thread direction and the second thread pitch is the same as the first thread pitch.

9. A device as recited in claim 7 further providing that the second thread direction is opposite the first thread direction and the second pitch is different from the first pitch.

10. A device as recited in claim 7 further providing that the second thread direction is the same as the first direction and the second pitch is different from the first pitch.

* * * * *